United States Patent [19]

Ohrberg

[11] 4,095,510

[45] Jun. 20, 1978

[54] RADIAL PISTON PUMP

[76] Inventor: Carl Verner Ohrberg, Poppelvej 1, Havnbjerg, Nordborg, Denmark, 6430

[21] Appl. No.: 628,045

[22] Filed: Nov. 3, 1975

[30] Foreign Application Priority Data

Nov. 2, 1974 Germany ..... 2452092

[51] Int. Cl.[2] ..... F01B 13/06

[52] U.S. Cl. ..... 91/487

[58] Field of Search ..... 91/472–498

[56] References Cited

U.S. PATENT DOCUMENTS

| | | | |
|---|---|---|---|
| 2,646,754 | 7/1953 | Overbeke | 91/475 |
| 2,895,426 | 7/1959 | Orshansky, Jr. | 91/485 |
| 2,932,256 | 4/1960 | Orshansky, Jr. | 91/491 |
| 3,010,405 | 11/1961 | Tomell | 91/475 |
| 3,044,412 | 7/1962 | Orshansky, Jr. | 91/492 |
| 3,068,805 | 12/1962 | Byers, Jr. | 91/484 |
| 3,274,898 | 9/1966 | Faisandier | 91/485 |

*Primary Examiner*—William L. Freeh

[57] ABSTRACT

The invention relates to a radial piston pump of the type in which a piston carrier, together with an end slide plate within a track carrier, produces one piston stroke per revolution. The piston carrier is rotatably disposed between two parallel housing surfaces and has distributing passsages opening at the end and cooperating with distributing apertures at the pressure and suction sides in at least one housing surface. At least one pressure surface, which is bounded by sealing rings, is in communication with the pressure side to force the piston carrier and slide plate apart. An annularly shaped corrugated spring is provided for aiding and supplementing the pressurized fluid in also pressing the piston carrier and slide plate apart.

1 Claim, 2 Drawing Figures

RADIAL PISTON PUMP

The invention relates to a radial piston pump of which the piston carrier, together with an end slide plate within a track carrier which causes one piston stroke per revolution, is rotatably disposed between two parallel housing surfaces and comprises distributing passages opening at the end and co-operating with distributing apertures at the pressure and suction sides in at least one housing surface, at least one pressure surface which is bounded by sealing rings and is in communication with the pressure side and a compression spring being provided for pressing the piston carrier and slide plate apart.

In a pump of this type, a distributing valve is formed along at least one of the parallel housing surfaces. In order that an adequate seal is obtained along this surface, a pressure is created between the piston carrier and slide plate which presses these parts apart. Since this pressure does not yet exist on starting the pump and it cannot build up if the valve function is inadequate, a spring is also provided between these two parts.

In a known radial piston pump of this kind, the spring is in the form of a compression spring which directly surrounds the drive shaft of the pump. By reason of this spring, the slide ring has a comparatively large axial thickness. This, in turn, affects the total axial length of the pump.

The invention is based on the object of providing a radial piston pump of the aforementioned kind, which comprises a thinner slide plate and the axial length of which can therefore be kept shorter.

This object is achieved according to the invention in that the compression spring is in the form of an annular corrugated spring and is disposed outside the pressure surface.

An annular corrugated spring has smaller dimensions in the axial direction as compared with a compression spring. The axial thickness of the slide plate therefore practically no longer depends at all on the length of the compression spring. The slide plate can therefore be of considerably thinner form. A corrugated spring, which is resilient within the limits of the tolerance, cannot be made as strong as a compression spring. However, if the compression spring is disposed at a large spacing from the drive shaft, a surprisingly adequate seal is achieved during starting. This is explained by the fact that the sealing problem exists substantially only on that side of the drive shaft to which the pump is to convey. The conveyed fluid escaping along the parallel housing walls presses the piston carrier and slide plate towards one another, whereby they tilt slightly with respect to one another. To counteract this tilting motion it is not only the size of the force of the compression spring but primarily its torque that is important. Because of the large radius of the corrugated spring, this is adequate even with a small spring force.

In a preferred example, wherein a plurality of dogs each consisting of a plug and socket and coaxial with a respective distributing passage are provided between the piston carrier and slide plate, and wherein sealing rings pushed over the plugs bound the pressure surfaces and are connected to the associated distributing passage, it is recommended that the sockets and an annular recess surrounding same and receiving the corrugated spring both extend from the end surface of the piston carrier, an extension of the slide plate being engaged in the recess. With this construction, the corrugated spring is guided on the piston carrier. The slide plate may also be guided at this position. Since the piston carrier can in other respects retain its thickness, there will also be no impermissible weakening of its cross-section.

The invention will now be described in more detail with reference to an example shown in the drawing. In the drawing.

Figure 1:
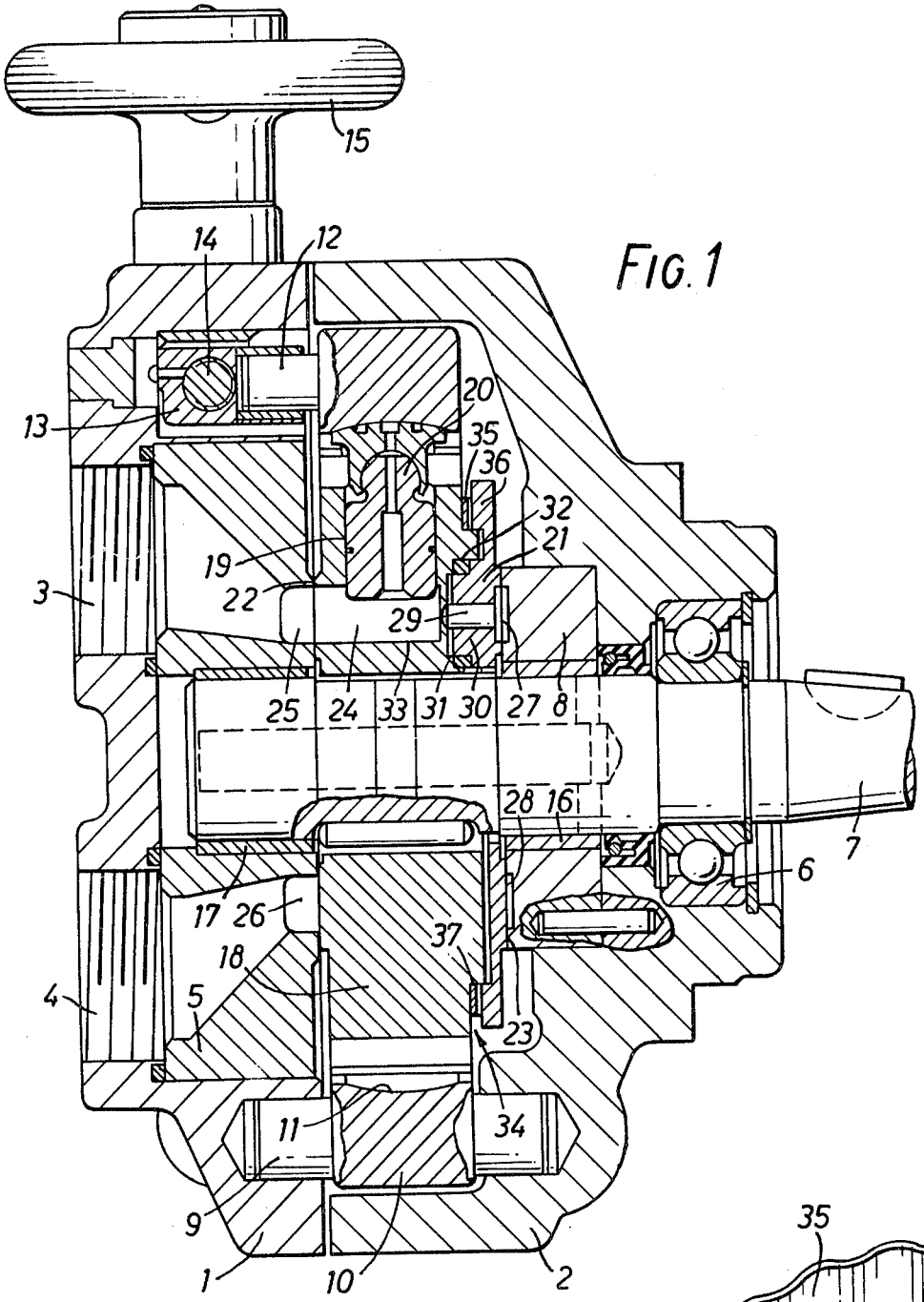
FIG. 1 is a longitudinal section through a radial piston pump.
Figure 2:
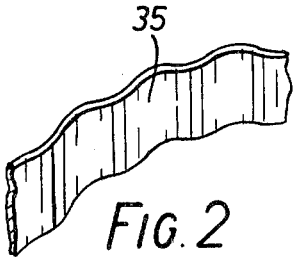
FIG. 2 is a fragment of the corrugated spring that is used.

A pump housing consists of two parts 1 and 2. The housing part 1 has two connecting nipples 3 and 4 for a pressure conduit and a suction conduit. It also receives a valve plate 5. The housing part 2 comprises a roller bearing 6 for a drive shaft 7 and carries an insert plate 8. In both housing parts 1 and 2 there is mounted the rotary pin 9 of a track carrier 10 which comprises a circular cam track 11 and on the opposite side carries a pin 12 at which a dog 13 engages. The latter has an internal screwthread so that, by means of a screw 14 which can be turned by the handwheel 15 by way of gearing, it is adjustable transversely to the plane of the drawing, whereby the conveyed volume and the direction of conveying of the radial pump can be changed.

The drive shaft 7 is further mounted in a slide bearing 16 in the insert plate 8 and in a slide bearing 17 in the valve plate 5. It is connected for rotation with a piston carrier 18 in the cylinders 19 of which pistons 20 are radially displaceable, the pistons being guided at the cam track 11. A slide plate 21 is disposed adjacent the piston carrier 18. Both parts are located between two parallel housing surfaces 22 at the valve plate 5 and 23 at the insert plate 8, against which they are to lie sealingly. Each cylinder 19 is associated with an axial distributing passage 24 of which the opening is in alternate communication with two distributing apertures 25 and 26 in the housing surface 22, the distributing apertures being associated with the connecting nipples 3 and 4. Grooves 27 and 28 having the shape of the distributing apertures 25 and 26 are provided in the housing surface 23. They are connected to the distributing passages 24 by way of axial holes 29 in the slide plate 21 and they serve to balance out the pressure.

As an extension of each axial distributing passage 24, the slide plate has plugs 30 which engage in corresponding sockets 31 of the piston carrier 18. Each plug is surrounded by a sealing ring 32 so that a pressure surface 33 is formed within this sealing ring. When pressure obtains in the distributing passage 24, a force is produced at this pressure surface that presses the piston carrier 18 and the slide plate 21 axially apart, the force depending on the size of the pressure surface and the size of the pressure. Outside the sockets 31 there is provided a recess 34 which likewise extends from the end of the piston carrier 18, in which an annular corrugated spring 35 is disposed and in which an extension 36 of the slide plate engages. The corrugated spring is a ring of spring metal which is provided with corrugations in the circumferential direction. A cylindrical surface 37 of the recess 34 can serve as a centering for the corrugated spring 35 and for the slide plate 21.

The arrangement of the piston carrier 18 and the slide plate 21 can also be turned through 180° so that the slide plate lies against the housing surface 22 if this is necessary.

The fluid conveyed in one or more distributing passages 24 upon starting first of all seeks to escape along the gaps between the piston carrier 18 and housing surface 22 or the slide plate 21 and the housing surface 23, so that the pressure required for the pressure surface 33 to become effective builds up only slowly. If one assumes that the upper distributing passage 24 contains conveyed fluid, the piston carrier 18 and slide plate 21 will tilt towards one another in the upper portion of the drawing. This tilting movement is counteracted by the corrugated spring 35 with a moment arm which is considerable because of the large diameter.

I claim:

1. A radial piston pump assembly comprising a housing, a stationary valve plate fixedly mounted in said housing, an insert plate fixedly mounted in said housing in spaced relation to said valve plate, bearing means in said plates, a shaft journaled in said bearing means, a piston carrier member attached to said shaft between said plates, a track carrier surrounding said piston carrier member and having a cam track surface cooperably engaging said piston carrier member a slide plate member surrounding said shaft and being disposed between said piston carrier member and said insert plate, an annularly shaped corrugated spring between said piston carrier member and said slide plate member resiliently biasing said members in opposite directions away from each other, a fluid passage extending through said members, a cylindrically shaped recess in one of said members surrounding said passage, a circular plug on the other of said members extending partially into said recess, a sealing ring surrounding said plug so that pressurized fluid is trapped in said recess to exert separating forces on said members.

* * * * *